US006578493B2

(12) United States Patent
Weise et al.

(10) Patent No.: US 6,578,493 B2
(45) **Date of Patent: *Jun. 17, 2003**

(54) ELECTROTHERMAL IGNITION DEVICE AND METHOD FOR PRODUCING THE DEVICE

(75) Inventors: Thomas Weise, Unterlüss (DE); Hans Karl Haak, Unterlüss (DE); Uwe Krone, Hamfelde (DE); Dirk Cegiel, Stubben (DE)

(73) Assignee: Rheinmetall W & M GmbH, Unterlüss (DE)

( * ) Notice: Subject to any disclaimer, the term of this patent is extended or adjusted under 35 U.S.C. 154(b) by 0 days.

This patent is subject to a terminal disclaimer.

(21) Appl. No.: 09/839,674

(22) Filed: Apr. 23, 2001

(65) Prior Publication Data

US 2002/0005136 A1 Jan. 17, 2002

(30) Foreign Application Priority Data

Apr. 22, 2000 (DE) ..... 100 20 019

(51) Int. Cl.[7] ..... F42B 5/08

(52) U.S. Cl. ..... 102/472; 102/430; 102/431; 102/202.7

(58) Field of Search ..... 102/430–433, 102/202, 202.5, 202.7, 202.9, 202.11, 470, 472; 89/7, 8

(56) References Cited

U.S. PATENT DOCUMENTS

| | | | | | |
|---|---|---|---|---|---|
| 2,926,566 | A | * | 3/1960 | Atkins et al. | 102/472 |
| 3,831,523 | A | * | 8/1974 | Thomas et al. | 102/202.11 |
| 3,844,216 | A | * | 10/1974 | Jakobs et al. | 102/472 |
| 5,227,577 | A | * | 7/1993 | Eich et al. | 102/202 |
| 6,164,208 | A | * | 12/2000 | Hsu et al. | 102/202 |
| 6,332,402 | B1 | * | 12/2001 | Weise et al. | 102/472 |
| 6,332,403 | B1 | * | 12/2001 | Weise et al. | 102/472 |
| 6,354,218 | B1 | * | 3/2002 | Weise et al. | 102/286 |

FOREIGN PATENT DOCUMENTS

| | | | | |
|---|---|---|---|---|
| FR | 1006141 | * | 4/1952 | 102/472 |

* cited by examiner

*Primary Examiner*—Harold J. Tudor
(74) *Attorney, Agent, or Firm*—Venable; Norman N. Kunitz

(57) ABSTRACT

The invention relates to an electrothermal ignition device for igniting a powder propellant charge (4), which comprises at least one electrically-conductive wire (11; 15; 19; 22), that extends, at least partially, through the propellant charge, and can be connected to a current source (3). The electrically-conductive wire (11; 15; 19; 22) is coated with a pyrotechnical ignition mixture (12; 16; 20)so that the ignition device can have a low electrical-energy requirement and be easily adapted to the different requirements placed on it. A mixture on a potassium perchlorate-zirconium ($KClO_4$—Zr) base has proven to be an advantageous ignition mixture.

6 Claims, 2 Drawing Sheets

ELECTROTHERMAL IGNITION DEVICE AND METHOD FOR PRODUCING THE DEVICE

CROSS REFERENCE TO RELATED APPLICATION

This application is related to concurrently filed commonly owned allowed U.S. application Ser. No. 09/839,675 corresponding to German Patent Application No. 100 020 020.6, filed Apr. 22, 2000.

BACKGROUND OF THE INVENTION

The invention relates to an electrothermal ignition device for a powder propellant charge. The invention further relates to a method for producing this type of device, as well as a cartridge using the device.

To ignite the propellant-charge powder in known cartridges having an electrothermal ignition device, a high current flows through a wire-type conductor in the floor-side or base region of the corresponding cartridge such that the conductor vaporizes explosively and initiates an arc discharge. This arc discharge then ignites the corresponding propellant-charge powder.

A disadvantage of purely-electrothermal ignition devices is that all of the energy required for a reproducible ignition must be made available electrically, resulting in a considerable requirement of electrical energy.

German Patent Application DE 199 21 379.8, which was not published prior to the present application, discloses that, instead of leading the wire-type conductors directly through the propellant charge, the wires are disposed inside tubes comprising propellant-charge powder. These propellant-charge-powder tubes then constitute ignition conduits inside the propellant charge.

In the activation of the ignition device, first the wire-type conductor vaporizes and an arc-plasma conduit forms inside the respective propellant-charge-powder tubes. Radiation-transport mechanisms transport the energy to the environment via the plasma conduits. This energy transport leads to a rapid ignition of the propellant-charge-powder tubes and their conversion for energy and pressure. The propellant-charge gases formed in the process by the propellant-charge-powder tubes, and the released arc radiation, effect a rapid, uniform ignition of the surrounding propellant-charge structure.

The unpublished document DE 199 21 379.8 also discloses replacing the electrically-conductive wires with a metallization that is applied to the inside of the propellant-charge-powder tubes.

In view of DE 199 21 379.8, it is the object of the invention to disclose an ignition device in which a reduced amount of electrically-supplied energy is required for igniting the powder propellant charge, and with which the advantageous properties of electrothermal ignition can be further utilized. It likewise is the object of the invention to provide a cartridge utilizing the ignition device according to the invention as well as a method for producing this type of ignition device.

SUMMARY OF THE INVENTION

The above object generally is achieved according to the invention with regard to the ignition device, by an electrothermal ignition device for igniting a powder propellant charge, comprising: at least one electrically-conductive wire that extends, at least partially, through the propellant charge, and is connectable to a current source; and a pyrotechnical ignition mixture coating the electrically-conductive wire at least in a partial region along its length.

The above object generally is achieved according to the invention with regard to the method, by a method for producing an ignition device as described above that comprises: providing a pyrotechnical ignition mixture that is a mixture on a potassium perchlorate-zirconium ($KClO_4$—Zr) base, and contains a polymer binder from the family of fluoroalkanes; supplying a suitable solvent to the admixture of the binder and the potassium perchlorate-zirconium mixture to produce an emulsion; applying the emulsion to the electrically-conductive wire, and subsequently evaporating the solvent.

Particularly advantageous, modifications and embodiments of the invention are disclosed.

The invention is essentially based on the concept of coating the electrically-conductive wire with a pyrotechnical ignition mixture instead of inserting the electrically-conductive wire into a propellant-charge-powder tube. A mixture on a potassium perchlorate-zirconium ($KClO_4$—Zr) base has proven to be an advantageous ignition mixture.

A polymer binder from the family of fluoroalkanes is preferably added to this mixture. As a result, the ignition mixture can be applied, from a solvent emulsion, to wires, and adheres securely to the wire after the solvent evaporates. The binder component also lends elastic properties to the ignition mixture adhering to the wire.

After the ignition mixture has been initiated by a current flowing through the wire, the mixture is converted; at temperatures of about 4000° C., zirconium oxide ($ZrO_2$) is formed, which supports the ignition of the propellant-charge powder as fine hot spots, and reduces the requirement of electrical energy.

Further details and advantages of the invention ensue from the exemplary embodiments explained below in conjunction with drawing figures.

DETAILED DESCRIPTION OF THE PREFERRED EMBODIMENTS

Figure 1:
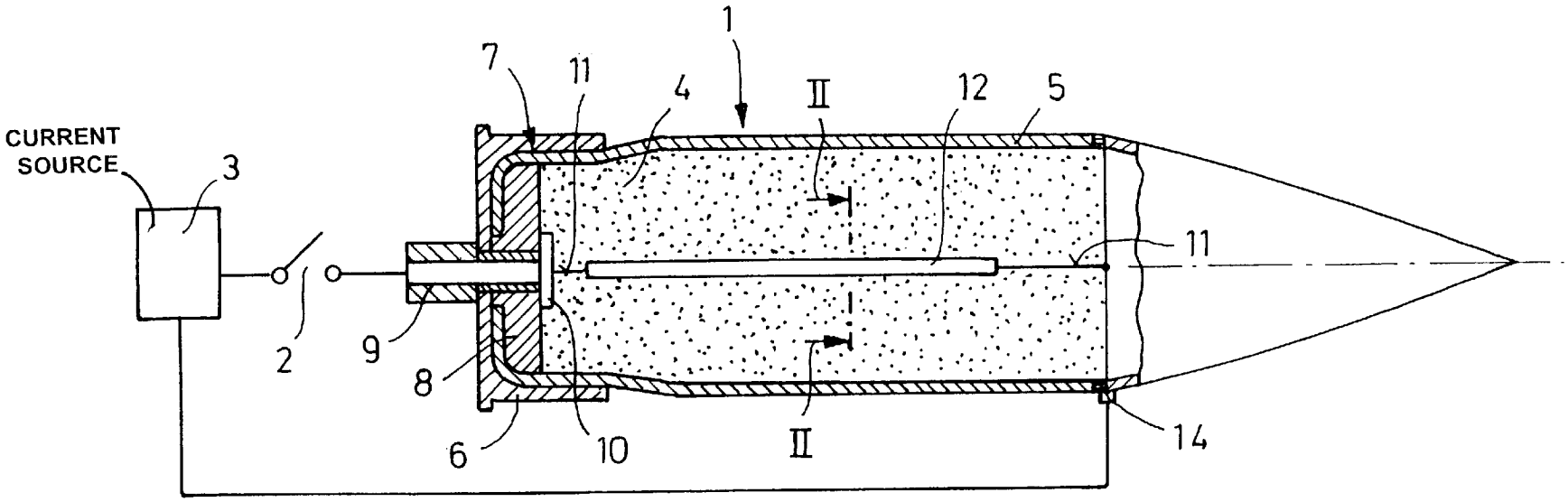
FIG. 1 is a longitudinal section through a cartridge having an ignition device according to the invention, the device including an electrically-conductive wire that has a homogeneous diameter, and is coated with an ignition mixture.

Turning now to FIG. 1, there is shown a cartridge, e.g., for firing from a tank gun. For ignition, the cartridge is connected to a current source 3 via a switch 2. For the sake of a clear overview, the corresponding gun in which the cartridge 1 is located is not shown.

The cartridge 1 includes a combustible sleeve or jacket 5, which is filled with a propellant charge 4, and a sleeve floor or base 6 at the floor-side or base end of the propellant-charge sleeve 5. In a lower region or end 7 of the sleeve 5, the combustible sleeve 5 is fixed in a form-fit between an insulating molded part 8 and the sleeve floor or base 6.

Disposed in the center of the base 6 is a high-voltage electrode 9, which is electrically insulated from the base.

The electrode 9 extends through the insulating molded part 8 and is connected to a metal disk 10 on the inward facing surface of the molded part 8.

Figure 2:
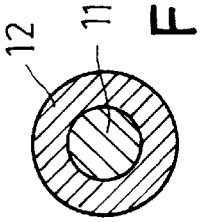
FIG. 2 is an enlarged representation of a cross-section of the cartridge of FIG. 1 through the coated wire, long the sectional line indicated by II—II in FIG. 1.

An electrically-conductive wire 11, whose diameter is homogeneous over its length, and which is coated with an ignition mixture 12 (FIG. 2), has one end secured to the metal disk 10. In the region of the top 13 of the propellant-charge sleeve 5, the wire 11 is connected to an annular or ring contact 14, which in turn, and during firing of the cartridge, contacts the inside wall of a gun, not shown, which wall is connected to ground potential.

For firing the cartridge 1, the switch 2 is closed, and the current source 3, which is provided with a series of charged capacitors (at a voltage of up to 40 kV), is abruptly discharged. The discharge current occurring in the process leads to an explosive vaporization of the wire 11 and the initiation of an arc plasma over the entire length of the wire 11. The interaction of the arc plasma and the ignition mixture 12 effects its initiation over the entire length of the coating 12, and the formed pyrotechnical particles are flung into the propellant charge 4.

Figure 3:
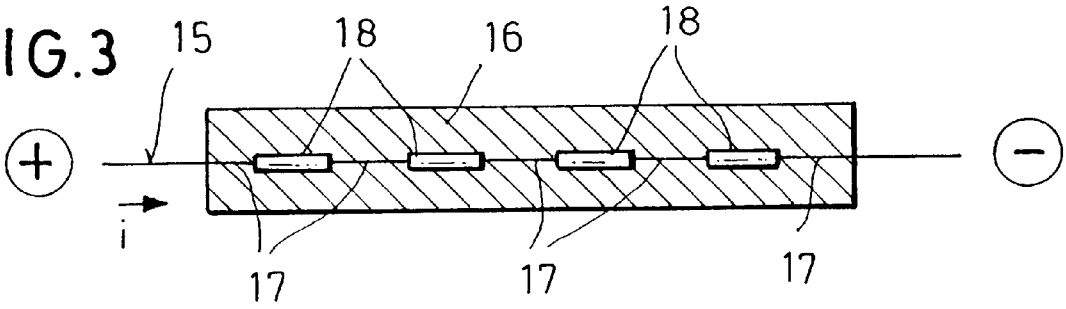
FIGS. 3–5 are three longitudinal sections through electrically-conductive wires that are respectively coated with an ignition mixture and have differently-shaped diameters.

FIG. 3 illustrates the structure of an arc-initiating wire 15, which has a non-homogeneous diameter and is coated with an ignition mixture 16. When an appropriately high current is introduced into the wire 15, the wire first vaporizes explosively in the regions 17 having a small in diameter. In these regions, therefore, the arc plasmas begin to form and interact with the ignition mixture 16. After a delay, arc plasmas form in the regions 18 of the wire 15, which have a larger diameter. The wire thickness and/or the current paths can be used to establish the desired time delay of the plasma production in the propellant charge. The spacing of the variations in the wire diameter can be used to effect a corresponding spatial distribution of the plasmas.

Figure 4:
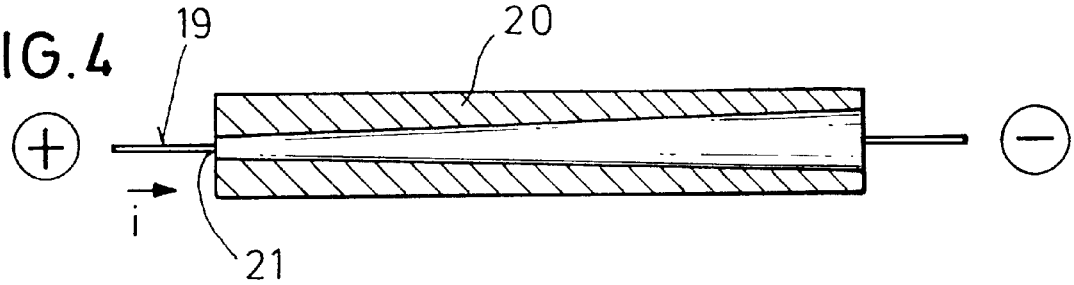

FIG. 4 illustrates an electrical wire 19, whose diameter is conical in the direction of the longitudinal axis, and which is coated with an ignition mixture 20. When an appropriately high current is introduced, the explosive vaporization first occurs at the point 21, where the wire 19 has its smallest diameter, then travels in the direction of the increase in diameter. This type of design permits ignition processes that take place in the longitudinal direction of the wire 19, and are controlled over time. The wire geometry and/or the shape of the current pulse determine(s) the speeds of the process.

Figure 5:
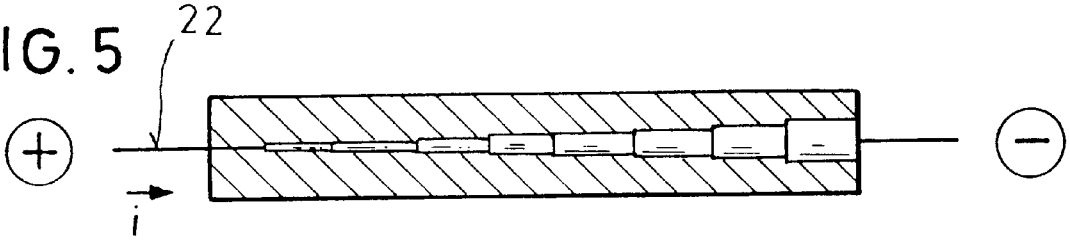

The same considerations also apply for the embodiment shown in FIG. 5, in which the diameter of an electrical wire 22 increases in a graduated fashion.

The invention is, of course, not limited to the above-described exemplary embodiments. For example, the ignition mixture can also be rendered electrically conductive through the admixture of appropriate additives.

The invention now being fully described, it will be apparent to one of ordinary skill in the art that many changes and modifications can be made thereto without departing from the spirit or scope of the invention as set forth herein.

What is claimed is:

1. A cartridge with an electrothermal ignition device, comprising:

a cartridge including a cylindrical combustible sleeve that is at least partially filled with a propellant-charge powder, and a metallic base that is connected to one end of the sleeve and forms a bottom of the cartridge;

a high-voltage electrode extending through the base and electrically insulated therefrom;

at least one electrically-conductive wire, which extends axially through the first propellant-charge powder, connected between the high-voltage electrode and an annular contact disposed adjacent another end of the sleeve; and, a pyrotechnical ignition mixture coating the at least one electrically-conductive wire, at least in a partial region along its length.

2. A cartridge according to claim 1 wherein the at least one wire has a non homogeneous diameter along its length.

3. A cartridge according to claim 1 wherein the at least one wire has a conically widening diameter along its length.

4. A cartridge according to claim 1 wherein the at least one wire has a step-wise gradually increasing diameter along its length.

5. The ignition device according to claim 1, wherein the pyrotechnical ignition mixture is a mixture on a potassium perchlorate-zirconium ($KClO_4$—Zr) base.

6. The ignition device according to claim 5, wherein the potassium perchlorate-zirconium mixture contains a polymer binder from the family of fluoroalkanes.

* * * * *